US010047498B2

(12) United States Patent
Law

(10) Patent No.: US 10,047,498 B2
(45) Date of Patent: Aug. 14, 2018

(54) METHOD FOR MANEUVERING A VESSEL

(71) Applicant: HATCH PTY LTD, Brisbane, Queensland (AU)

(72) Inventor: Kim Tai Law, Wembley Downs (AU)

(73) Assignee: Hatch Pty Ltd, Brisbane, Queensland (AU)

( * ) Notice: Subject to any disclaimer, the term of this patent is extended or adjusted under 35 U.S.C. 154(b) by 0 days.

(21) Appl. No.: 15/021,306

(22) PCT Filed: Sep. 12, 2014

(86) PCT No.: PCT/AU2014/000908
§ 371 (c)(1),
(2) Date: Mar. 11, 2016

(87) PCT Pub. No.: WO2015/035461
PCT Pub. Date: Mar. 19, 2015

(65) Prior Publication Data

US 2016/0222628 A1 Aug. 4, 2016

(30) Foreign Application Priority Data

Sep. 12, 2013 (AU) ..... 2013903498

(51) Int. Cl.
*E02F 9/06* (2006.01)
*B63B 35/44* (2006.01)
(Continued)

(52) U.S. Cl.
CPC ..... *E02F 9/065* (2013.01); *B63B 35/4413* (2013.01); *E02F 5/282* (2013.01); *E21C 50/02* (2013.01)

(58) Field of Classification Search
CPC ..... E02F 5/282; E02F 9/065; E21C 50/02; B63B 35/4413; B63B 35/44; B63B 39/06; B63B 2213/02
(Continued)

(56) References Cited

U.S. PATENT DOCUMENTS 3,699,572 A 10/1972 Vlasov et al.
3,948,201 A * 4/1976 Takeda ..... B63B 21/50 114/144 B
(Continued)

FOREIGN PATENT DOCUMENTS

GB 1267553 A 3/1972

OTHER PUBLICATIONS

International Search Report and Written Opinion of the ISA for PCT/AU2014/000908, ISA/AU, Woden ACT, dated Nov. 19, 2014.
(Continued)

*Primary Examiner* — Nga X Nguyen
(74) *Attorney, Agent, or Firm* — Harness, Dickey & Pierce, P.L.C.

(57) ABSTRACT

A method for the maneuvering of a vessel, such as a dredge, stacker, barge or wet concentrator plant, the vessel having provided thereon at least four winches from which winch ropes extend to anchor points located remotely from the vessel, the winches being operable to maneuver the vessel, wherein at least one winch is kept under a defined torque whilst three winches are utilized to control the movement of the vessel. A maneuvering control system for implementing the method of maneuvering described is also disclosed.

33 Claims, 10 Drawing Sheets

(51) Int. Cl.
*E21C 50/02* (2006.01)
*E02F 5/28* (2006.01)

(58) Field of Classification Search
USPC ..... 114/126, 140, 265
See application file for complete search history.

(56) References Cited

U.S. PATENT DOCUMENTS 4,177,585 A * 12/1979 de Koning ..... E02F 3/905 37/195
2005/0121230 A1* 6/2005 Baek ..... E21B 7/128 175/5

OTHER PUBLICATIONS

International Preliminary Report on Patentability for PCT/AU2014/000908, dated Mar. 15, 2016.
Examination Report under Section 18(3) for GB1603453.0, dated Jun. 23, 2017.

* cited by examiner

METHOD FOR MANEUVERING A VESSEL

CROSS-REFERENCE TO RELATED APPLICATIONS

This application is a 371 U.S. National Stage of International Application No. PCT/AU2014/000908, filed Sep. 12, 2014, which claims the benefit of and priority to Australian Patent Application No. 2013903498, filed Sep. 12, 2013. The entire disclosures of the above applications are incorporated herein by reference.

FIELD OF THE DISCLOSURE

The present disclosure relates to a method for maneuvering a vessel.

In another form the present disclosure relates to a mining method. More particularly, the mining method of the present disclosure incorporates dredging, specifically the maneuvering of a dredge.

In a further form the present disclosure relates to a stacking method. More particularly, the stacking method of the present disclosure is applicable to the stacking of tailings, such as may be generated in mining and mineral processing operations.

In a still further form the present disclosure relates to a maneuvering control system for the implementation of any of the methods noted above and described hereinafter.

BACKGROUND ART

Conventional dredging methods employed in mining typically utilize a spud (which is a vertical pole-like assembly incorporated within the dredge) to anchor the dredge to the bed and sideline winches to slew the dredge clockwise and anticlockwise while it cuts into the ore body.

At the end of each slew, the cutter head is advanced by extending the spud carriage (maximum extension for a spud dredge is 7-10 m). Once the carriage is fully extended, an auxiliary spud is dropped and the main spud raised, allowing the dredge to "walk" forward. Once in the new position, the spud carriage is retracted, the auxiliary spud raised and the main spud dropped allowing mining to continue.

There are a number of drawbacks associated with this type of dredging. Since the spud provides the main reaction force for the cutter, it is not possible to continue mining any virgin area during a spud walk, leading to a typical 5 to 15 minute loss of production with every "walk". Hence, the continuous mining area for an anchor and spud setting is around 15×50 meters.

The length of the dredge cutter ladder limits the mine width for each spud centerline, as shown in FIG. 1. Hence, for a mine width typically greater than the spud dredge slew arc (typically 50 to 60 meters), it is necessary to have multiple spud centerlines, which also leads to a typical 15 to 60 minute production loss due to the required spud "crab" motion with each centerline change.

Mining-arcs are non-concentric following a spud walk, since the center of the arc and the radius of the arc are changing. This means that unless the slewing speed is controlled to compensate for this effect, the effective cutting rate across the face will be inconsistent.

The heading on a spud dredge is always fixed with respect to the mine face. The heading can not be changed to increase efficiency.

The length and size requirements of the spud increase with the depth of operation, with spud dredge applications typically limited to a maximum mining depth of 22 meters.

There is also a need for complex anchor position planning to ensure sufficient slew forces for the cutter which often requires more anchor moves.

The present disclosure has as one object thereof to overcome substantially the abovementioned problems of the prior art, or to at least provide a useful alternative thereto.

The Applicant has understood and identified that it would be advantageous to provide a new method for the maneuvering of a vessel, such as either a dredge or a stacker used in mining. Such advantages are understood to include, but not be limited to: allowing a dredge to move in a straight line rather than the arcuate movement typical of the prior art; ability to control heading to, inter alia, improve efficiency; improving dredge production availability by minimizing or reducing unproductive downtime due to spud walk and spud crab motion; using a spudless dredge design, the mining area can be improved to at least around 45×200 meters for each set of anchor placements compared to a typical spud dredge mining area of 15×50 meters; for a spud dredge mining a 200 meters wide mine pond, this translates to three spud walks per centerline and three spud crab motions across the pond resulting in more than a one hour loss in production time for every 45×200 meter mining area.

Further advantages include improving and streamlining the cutting trajectory to improve dredging performance, particularly near the pond corner edges, developing a cutting trajectory and cutting sequence that ensures a consistent bite of cut into the ore body, providing a heading that maximizes cutting efficiency, and developing a dredge maneuvering control method that can be used for both shallow and deep operation. It is typically difficult to use spud dredges for depths greater than 22 meters, unless steps are taken to reduce the pond level.

Still further advantages include maximizing the overall production rate by using advanced control techniques to maximize dredge slewing and cutting speed while minimizing cutter trip due to overload, improving the level of automation thus reducing operator input, and formulating an anchor relocation strategy that optimizes the overall production throughput by minimizing the requirements for anchor-move frequency without losing effective available maneuvering forces.

The preceding discussion of the background art is intended to facilitate an understanding of the present disclosure only. The discussion is not an acknowledgement or admission that any of the material referred to is or was part of the common general knowledge as at the priority date of the application.

Throughout the specification and claims, unless the context requires otherwise, the word "comprise" or variations such as "comprises" or "comprising", will be understood to imply the inclusion of a stated integer or group of integers but not the exclusion of any other integer or group of integers.

Throughout the specification and claims, unless the context requires otherwise, reference to a "dredge" or variations such as "dredges" or "dredging", will be understood to include reference to a "vessel", and vice versa. Similarly, unless the context requires otherwise, reference to either a dredge or vessel, or variations thereof, are to be understood to include reference to a wet concentrator plant, a "stacker", a "stacker module", or a module such as may be employed in berthing or docking of a vessel. For example, reference to a dredge is understood to include reference to deep sea dredges and channel dredges. Further, reference to a vessel is understood to include reference to a marine barge, for example.

Throughout the specification and claims, unless the context requires otherwise, reference to one of a "line", "rope" or "cable", or variations thereof, is to be understood to include reference to each other term and each should be interpreted inclusively. Further, the term "winch" or variations thereof, unless the context requires otherwise, is to be understood to include reference to any other mechanism by which a vessel may be drawn towards a point remote from that vessel.

Throughout the specification and claims, unless the context requires otherwise, reference to "defined torque", or variations thereof, is to be understood to refer to a winch that is controlled under a 'Torque Control mode' or a winch that has a torque limit when placed under a 'Speed Control mode'.

Throughout the specification and claims, unless the context requires otherwise, reference to "permissible moving region", or any variation thereof, is to be understood to include reference to "permissible cutting region", or vice versa, as may be applicable in the particular context.

SUMMARY

In accordance with the present disclosure there is provided a method for the maneuvering of a vessel, the vessel having provided thereon at least four winches from which winch ropes extend to anchor points located remotely from the vessel, the winches being operable to maneuver the vessel, wherein at least one winch is kept under a defined torque while three winches are utilized to control the movement of the vessel.

Preferably, the or each winch under defined torque is kept at or near the lowest torque value that achieves a low potential energy while maintaining that winch rope in a responsive state.

Still preferably, the vessel is maneuvered via a maneuvering controller sending torque and speed parameters to the winches.

Still further preferably, the vessel is maneuvered in accordance with a preferred trajectory for the vessel.

A Redundant Winch Identifier (RWI) component is preferably provided for determining which winch or winches should not be utilized to achieve a desired maneuver of the vessel. The RWI preferably achieves this through analysis of which winch(es) is/are least capable of doing useful work in achieving the desired output or result.

The selection of winches as redundant or not is preferably a function of parameters of each of the preferred trajectory, vessel geometry and desired velocity.

Preferably, the RWI adopts a proactive approach to the selection of the or each redundant winch.

Still preferably, in circumstances in which the RWI is unable to adopt a proactive approach to the selection of the or each redundant winch, a reactive approach to the selection of the or each redundant winch is adopted.

Preferably, the proactive approach of the RWI component comprises:

(a) an acceleration calculator, which calculates the vessel's acceleration from the vessel's desired velocity;

(b) a vessel-to-winch velocity converter, which calculates desired velocities of the winches from said vessel's geometry and desired velocity;

(c) a scalar projection calculator, which provides a quantitative comparison of the desired acceleration of sheaves provided on the vessel and associated with each rope and winch, to the desired accelerations of their respective winch ropes; and (d) a customized minimum selector, which identifies the redundant winches based on the output of an acceleration calculator and a scalar projection calculator.

Preferably, the reactive approach of the RWI component comprises:

(a) a calculator for converting winch torque feedback to line tension;

(b) a customized minimum selector that acts to identify the or each winch most suitable for redundant winch selection; and (c) a check to determine that the or each winch selected as a redundant winch is performing as expected.

Still preferably, the expected performance of the or each redundant winch is such that the winches velocity is at or near its desired velocity. If a redundant winch is determined not to be operating as expected it is removed from consideration as a redundant winch for a period of time.

Preferably, the maneuvering controller takes into account factors that limit the maximum speed of the vessel.

Amongst the factors that limit the maximum speed of the vessel is preferably an Input/Output protection factor. The Input/Output protection factor preferably acts to limit the speed of the vessel so as to protect an Input or Output device from providing an undesirable result.

In one form of the present disclosure the input or output device is provided in the form of a cutter head. Preferably, the Input/Output protection factor comprises cutter trip protection.

In another form of the present disclosure the input or output device is provided in the form of a stacking boom.

A further factor that limits the maximum speed of the vessel is a process protection factor. The process protection factor preferably acts to limit the speed of the vessel in order to protect a downstream/upstream process from interruption or other negative impact.

In one form of the present disclosure the process protection factor is provided in the form of a 'Dredge to WCP Process Line Bog Protection' factor.

An operator may preferably modify the vessel's trajectory or initiate a new trajectory by sending instructions to the maneuvering controller via a graphical user interface (GUI).

Preferably, the GUI comprises an X-Y plot depicting a top plan view of the vessel. The X-Y plot preferably allows the operator to visualize the vessel in real time relative to a current preferred trajectory. Still preferably, the X-Y plot further allows the operator to visualize historical information regarding the position of the vessel.

Still preferably, the real time and historical information depicted on the X-Y plot is provided in a manner in which each is readily distinguishable from the other. In one form of the present disclosure the real time and historical information depicted on the X-Y plot is provided in differing colors.

The X-Y plot may preferably be enhanced so as to provide 3-dimensional visualization of the vessel in real time and the historical information in each of an X, Y and Z coordinate.

Preferably, the instructions from the operator are interpreted by the maneuvering controller, and the controller output to the winches is adjusted accordingly to achieve the operator's intentions.

Location of the anchor points is preferably achieved by identifying permissible moving regions (PMRs), being an area in which movement is possible as the anchor locations can provide sufficient forces for that movement through the winches.

Preferably, the identification of PMRs is achieved through use of an anchor movement force calculator, by which winch forces may be calculated for specified anchor positions and trajectory.

In one form of the present disclosure the vessel is provided in the form of a spudless dredge.

In a further form of the present disclosure the vessel is provided in the form of a spudless wet concentrator plant (WCP).

In a still further form of the present disclosure the vessel is provided in the form of a spudless stacker module. Preferably the stacker module is a tailings stacker module.

In accordance with the present disclosure there is further provided a mining method, the method incorporating the maneuvering of a dredge, the dredge having provided thereon at least four winches from which winch ropes extend to anchor points located remotely from the dredge, the winches being operable to maneuver the dredge, wherein at least one winch is kept under a defined torque while three winches are utilized to control the movement of the dredge.

Preferably, the or each winch under defined torque is kept at or near the lowest torque value that achieves a low potential energy while maintaining that winch rope in a responsive state.

Still preferably, the dredge is maneuvered via a maneuvering controller sending torque and speed parameters to the winches.

Still further preferably, the dredge is maneuvered in accordance with a preferred trajectory for the dredge.

A Redundant Winch Identifier (RWI) component is preferably provided for determining which winch or winches should not be utilized to achieve a desired maneuver of the dredge. The RWI preferably achieves this through analysis of which winch(es) is/are least capable of doing useful work in achieving the desired output or result.

The selection of winches as redundant or not is preferably a function of parameters of each of the preferred trajectory, dredge geometry and desired velocity.

Preferably, the RWI adopts a proactive approach to the selection of the or each redundant winch.

Still preferably, in circumstances in which the RWI is unable to adopt a proactive approach to the selection of the or each redundant winch, a reactive approach to the selection of the or each redundant winch is adopted.

Preferably, the proactive approach of the RWI component comprises:

(a) an acceleration calculator, which calculates the dredge's acceleration from the dredge's desired velocity;

(b) a dredge-to-winch velocity converter, which calculates desired velocities of the winches from the dredge's geometry and desired velocity;

(c) a scalar projection calculator, which provides a quantitative comparison of the desired acceleration of sheaves provided on the dredge and associated with each rope and winch, to the desired accelerations of their respective winch ropes; and (d) a customized minimum selector, which identifies the redundant winches based on the output of an acceleration calculator and a scalar projection calculator.

Preferably, the reactive approach of the RWI component comprises:

(a) a calculator for converting winch torque feedback to line tension;

(b) a customized minimum selector that acts to identify the or each winch most suitable for redundant winch selection; and (c) a check to determine that the or each winch selected as a redundant winch is performing as expected.

Still preferably, the expected performance of the or each redundant winch is such that the winches velocity is at or near its desired velocity. If a redundant winch is determined not to be operating as expected it is removed from consideration as a redundant winch for a period of time.

Preferably, the maneuvering controller takes into account factors that limit the maximum speed of the dredge.

Amongst the factors that limit the maximum speed of the dredge is preferably an Input/Output protection factor. The Input/Output protection factor preferably acts to limit the speed of the dredge so as to protect an Input or Output device from providing an undesirable result.

In one form of the present disclosure the input or output device is provided in the form of a cutter head. Preferably, the Input/Output protection factor comprises cutter trip protection.

A further factor that limits the maximum speed of the dredge is a process protection factor. The process protection factor preferably acts to limit the speed of the dredge in order to protect a downstream/upstream process from interruption or other negative impact.

In one form of the present disclosure the process protection factor is provided in the form of a 'Dredge to WCP Process Line Bog Protection' factor.

An operator may preferably modify the dredge's trajectory or initiate a new trajectory by sending instructions to the maneuvering controller via a graphical user interface (GUI).

Preferably, the GUI comprises an X-Y plot depicting a top plan view of the vessel. The X-Y plot preferably allows the operator to visualize the dredge in real time relative to a current preferred trajectory. Still preferably, the X-Y plot further allows the operator to visualize historical information regarding the position of the dredge.

Still preferably, the real time and historical information depicted on the X-Y plot is provided in a manner in which each is readily distinguishable from the other. In one form of the present disclosure the real time and historical information depicted on the X-Y plot is provided in differing colors.

The X-Y plot may preferably be enhanced so as to provide 3-dimensional visualization of the dredge in real time and the historical information in each of an X, Y and Z coordinate.

Preferably, the instructions from the operator are interpreted by the maneuvering controller, and the controller output to the winches is adjusted accordingly to achieve the operator's intentions.

Location of the anchor points is preferably achieved by identifying permissible cutting regions (PCRs), being an area in which movement is possible as the anchor locations can provide sufficient forces for that movement through the winches.

Preferably, the identification of PCRs is achieved through use of an anchor movement force calculator, by which winch forces may be calculated for specified anchor positions, estimated cutter forces and trajectory.

In accordance with the present disclosure there is still further provided a stacking method, the stacking method incorporating the maneuvering of a stacker module, the stacker module having provided thereon at least four winches from which winch ropes extend to anchor points located remotely from the stacker module, the winches being operable to maneuver the stacker module, wherein at least one winch is kept under a defined torque while three winches are utilized to control the movement of the dredge.

In accordance with the present disclosure there is yet still further provided a method for maneuvering a module, the module having provided thereon at least four winches from which winch ropes extend to anchor points located remotely from the module, the winches being operable to maneuver the module, wherein each winch and rope is dynamically maintained, at least one winch being kept under a defined torque while three winches are utilized to control the movement of the vessel.

Preferably, the module is one of either a vessel, a dredge, a barge, a wet concentrator plant, or a stacker module.

A maneuvering control system for the implementation of any one or more of the methods as described hereinabove.

BRIEF DESCRIPTION OF THE DRAWINGS

The present disclosure will now be described, by way of example only, with reference to several embodiments thereof and the accompanying drawings, in which:—

BEST MODES FOR CARRYING OUT THE DISCLOSURE

The present disclosure provides each of a method for the maneuvering of a vessel, for example a dredge, a method of mining incorporating dredging, specifically the maneuvering of a dredge, a stacking method with particular application in the stacking of tailings, and a maneuvering control system for the implementation of any of these methods. The methods of the present disclosure advantageously provide for the movement of a control point, to be described hereinafter, on a vessel along a preferred trajectory, in accordance with each of X and Y coordinates, a vessel heading, and optionally a Z coordinate.

Figure 1:
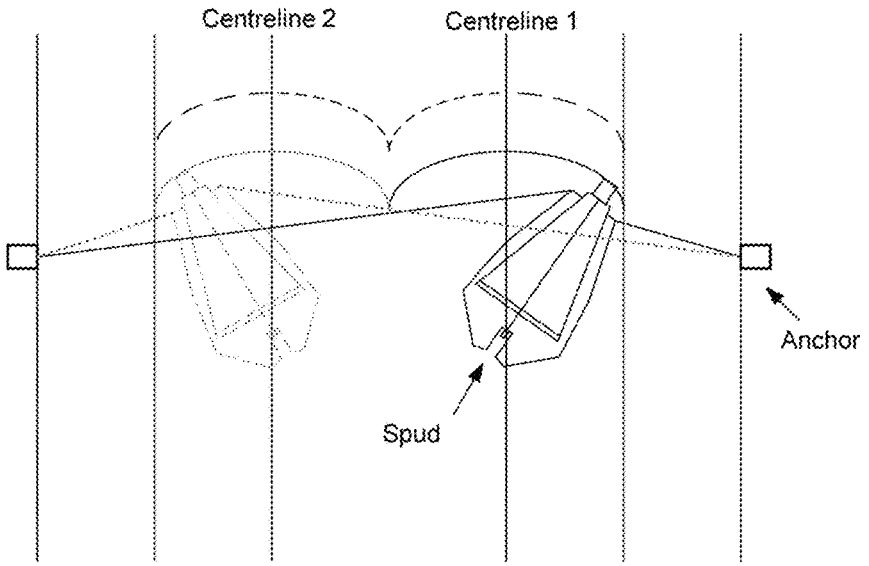
FIGURE 1 (Prior Art)
FIG. 1 is a diagrammatic top plan view of traditional spud dredging in accordance with the prior art.
Figure 2:
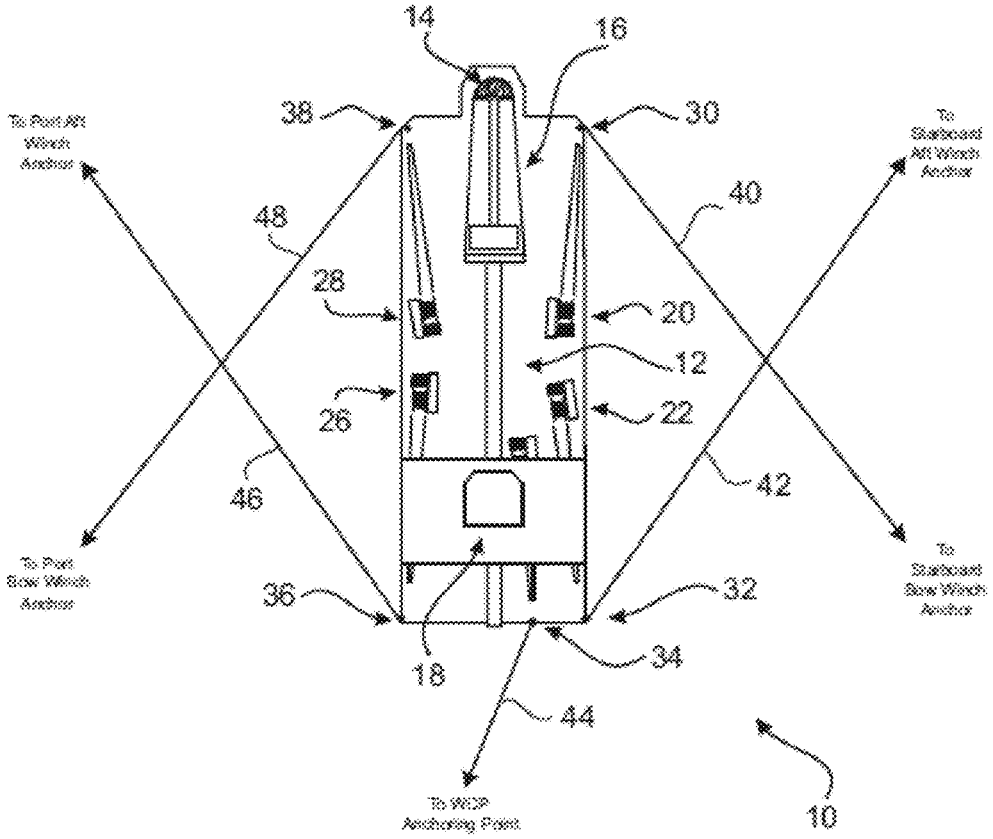
FIG. 2 is a top plan view of a dredge such as may be employed in a method of maneuvering a vessel and a method of mining, both in accordance with the present disclosure.

A vessel to be maneuvered, for example a spudless dredge 10, is shown in FIG. 2. The dredge 10 is designed with a view to using winch ropes for maneuvering, thereby aiming to avoid the problems associated with dredges of the prior art utilizing spuds. The dredge 10 comprises a platform 12, on which is provided a cutter 14, a cutter ladder 16, a control room 18, and a series of winches. The series of winches includes a starboard bow winch 20, a starboard aft winch 22, a tail winch 24, a port aft winch 26, and a port bow winch 28.

The dredge 10 further comprises a starboard bow sheave 30, a starboard aft sheave 32, a tail sheave 34, a port aft sheave 36, and a port bow sheave 38. Each of the winches 20 to 26 is provided with a winch line or rope 40 to 48, respectively, that extends to a respective anchor positioned remotely from the dredge 10.

Figure 3:
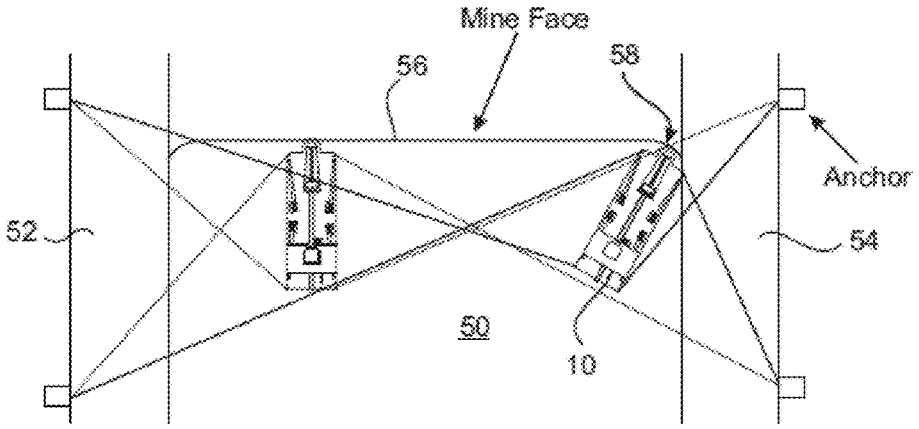
FIG. 3 is a diagrammatic top plan view of a mining method in accordance with the present disclosure.

Through the maneuvering of the dredge 10 by way of specific and selective operation of the series of winches, to be described hereinafter, a method of dredging or mining, as shown in FIG. 3, may be realized. In FIG. 3 the trajectory of the dredge 10 is shown to extend laterally across a pond or channel 50, between left and right banks 52 and 54, respectively, defining the channel 50, in which it is operating. The trajectory of the dredge 10 is coincident with a mine face 56 that is effectively defined thereby.

The preferred mode of operation, or trajectory, for the dredge 10 is understood to be a straight line without having the dredge hit the banks 52 and 54. However, the preferred trajectory may vary close to the banks 52 and 54. Whether this is the case or not is determined in many respects by the geometry/geography of the banks 52 and 54, with higher banks/walls being more problematic and requiring the dredge 10 to adopt a final arcuate or slewed trajectory 58 as it approaches the banks 52 and 54, as shown in FIG. 3.

The Applicants understand that the trajectory of the dredge 10 is dependent to some extent on the nature of the cutter 14, as each form of cutter that may be employed has its own unique geometry. For example, the geometry of a rose head cutter is different to that of a bucket-wheel cutter, and will have different offset angles. The particular geometry of the cutter employed may require varying heading control to ensure maximum cutting efficiency.

An operator may modify the vessel's trajectory or initiate a new trajectory by sending instructions to a maneuvering controller via a graphical user interface (GUI). The GUI comprises an X-Y plot depicting a top plan view of the vessel that allows the operator to visualize the vessel in real time relative to a current preferred trajectory. Additionally, the X-Y plot further allows the operator to visualize historical information regarding the position of the vessel.

Significantly, the real time and historical information depicted on the X-Y plot is provided in a manner in which each is readily distinguishable from the other. For example, the real time and historical information depicted on the X-Y plot may be provided in differing colors.

The X-Y plot may preferably be enhanced so as to provide 3-dimensional visualization of the vessel in real time and the historical information in each of an X, Y and Z coordinate.

Instructions from the operator are interpreted by the maneuvering controller, and the controller output to the winches is adjusted accordingly to achieve the operator's intentions.

The methods of the present disclosure present a number of advantages relative to the methods of the prior art and these advantages will be discussed in detail below. It is to be understood that reference in the following examples to a dredge is not limiting and that the principles discussed are generally equally applicable to the methods of the present disclosure as applied to other vessels, including stackers and barges.

Control Model Development

Early in the development of the methods of the present disclosure a theoretical analysis of dredge or vessel geometry, and development of a control model to act as a representation of the actual dredge or vessel, was undertaken by the Applicant. The development and application of this model facilitated the innovative design features of the methods of the present disclosure.

The purpose of the control model was to:

(a) Understand the machine dynamics of the dredge maneuvering system.

(b) Develop, investigate and optimize the dredge maneuvering control strategies.

(c) Check the robustness of the control strategies with respect to uncertainty of the anchor positions.

(d) Provide a means of investigating the effects of anchor positions on the forces from the winches.

(e) Provide an optimizing tool for anchor movement.

(f) Facilitate full functionality testing of the automation software.

The control model consists of two sections, being the:

(a) Dredge Dynamic Model; and (b) Dredge Maneuvering Force Calculator.

The language chosen for the development and implementation of the model is an industry standard simulation language, Matlab™/Simulink™. The model is described in the form of block diagrams using the block diagram language Simulink™. The model parameters in each block diagram are specified as Matlab™ variables, whose values were stored in Matlab™ macro files. Different trajectories and anchor positions can be entered into the system via a model user interface.

The model was connected to programmable logic controller (PLC) software using the Mathworks™ OPC Toolbox™ in order to facilitate full functionality testing of the software.

Matlab™, Simulink™ and Mathworks™ OPC Toolbox™ are industry standard software products, widely utilized, and are described in full and available from mathworks.com.au amongst other sites and suppliers.

Dredge Dynamic Model

Figure 4:
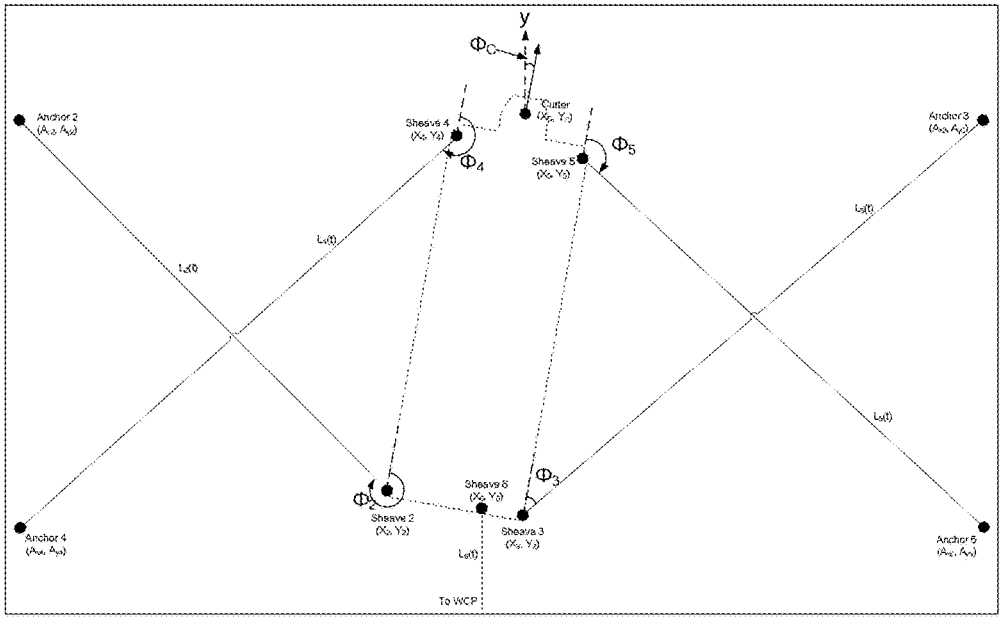
FIG. 4 is a diagrammatic top plan view of a dynamic model of the overall dredge geometry in accordance with both the method for maneuvering a vessel and the method of mining in accordance with the present disclosure.

This section of the model simulates dredge maneuvering and is based on the overall dredge geometry diagram, as shown in FIG. 4, wherein like numerals denote like parts with reference to the dredge 10 of FIG. 2 FIG. 4 depicts and defines the component coordinates, including cutter ($X_c$, $Y_c$), rope sheaves 2 ($X_2$, $Y_2$) to 6 ($X_6$, $Y_6$), anchors 2 ($A_{x2}$, $A_{y2}$) to 5 ($A_{x5}$, $A_{y5}$), rope lengths $L_2$ to $L_5$, rope angles $\phi$2 to $\phi$6 and heading angle $\phi$C, which are used in the model equations. The disclosure of FIG. 4 will be discussed in greater detail in the Examples hereinafter.

In simple terms, development of the model was based on the following steps.

Derivation of rope length equations using trigonometry. First and second order differentiation of these equations to determine rope velocity and rope acceleration.

Since rope length acceleration is directly related to the winch forces (F=m*A), winch forces can be related to the dredge acceleration.

Using the geometrical relationship between the dredge and the anchor points, and Newtonian laws relating force to acceleration, the resultant forces can be used to calculate the linear acceleration of the dredge. Similarly, the angular acceleration of the dredge can calculated using moments in place of forces, based on the dredge 10 as a point mass centered on its center of gravity with the origin (cutter head 14) as the point of rotation or control point. The resultant moment around the dredge origin is found by summing the moments supplied from each of the winches 20, 22, 24, 26, and 28. It is understood by the Applicants that other forms of vessel require that a suitable control point be identified or nominated for the purposes of these calculations.

Other forces addressed in developing the model include:

(a) Trailing rope tension;

(b) Cutting force;

(c) Water drag; and (d) Rope weight.

The Dredge Dynamic Model was coupled to a PLC controller to prove the integrity of the control strategies and to facilitate testing, including the use of one or more Human Machine Interface (HMI) displays for monitoring simulated operation.

The inputs to the Dredge Dynamic Model are the winch speed and torque references outputted by the PLC controller. Within the model are individual PI (Proportional Integral) controllers representing each maneuvering winch drive. These iteratively calculate the actual torque and speed of the drives and send as feedback to the PLC controller. Additionally, each winch drive torque is used to determine line tension and, together with the line angles, the forces on the dredge are summed to derive the net acceleration. The net acceleration is then integrated twice to determine dredge position which is fed back to the controller as a representation of GPS position input.

Dredge Maneuvering Force Calculator

The force calculator section of the model was developed to investigate the effects of different anchor positions. By specifying anchor positions, estimated cutter forces and trajectory, the force calculator calculates the winch forces required. This facilitates investigation of optimal trajectory, and anchor orientations and positions.

Optimizing the movements of the anchors is achieved by identifying permissible cutting regions (PCR) with every set of anchor locations. A PCR is defined as a physical area in which mining is practicable, defined in that a current set of anchor locations allows sufficient forces to be generated via the winches for cutting to occur. If sufficient forces can not be generated with a particular set of anchor locations then mining will not be considered practicable.

The anchor movement force calculator has been extended to determine the PCRs for each set of anchor locations, allowing these locations to be optimized and anchor step advance requirements to be determined.

A graphical user interface was developed using Matlab™ to configure and run the dredge model and simulation. This configuration interface was implemented into the HMI and allows entry of the following user inputs:

(a) Anchor positions;

(b) Initial dredge position;

(c) Desired trajectory parameters;

(d) Mining pond specification; and
(e) Simulated forces on cutter from the mine face.

Once the inputs have been entered, the simulation is run. During the simulation, the following outputs can be viewed:

(a) Trajectory shape;
(b) Dredge position;
(c) Winch line angles and lengths;
(d) Winch line tensions required;
(e) Maximum and minimum winch line tension available;
(f) Magnitude and direction of forces on dredge from mine face and water drag;
(g) Elapsed time; and
(h) Faults caused by over maximum winch torque, over maximum winch line length, collision with pond bank, and incompatible winch line angle, are captured and displayed.

The above outputs are used to manage and optimize anchor locations, the mining trajectory shape and general dredge operation.

Redundant Winch Identification for a Winch-Maneuvered Vessel

Figure 7:
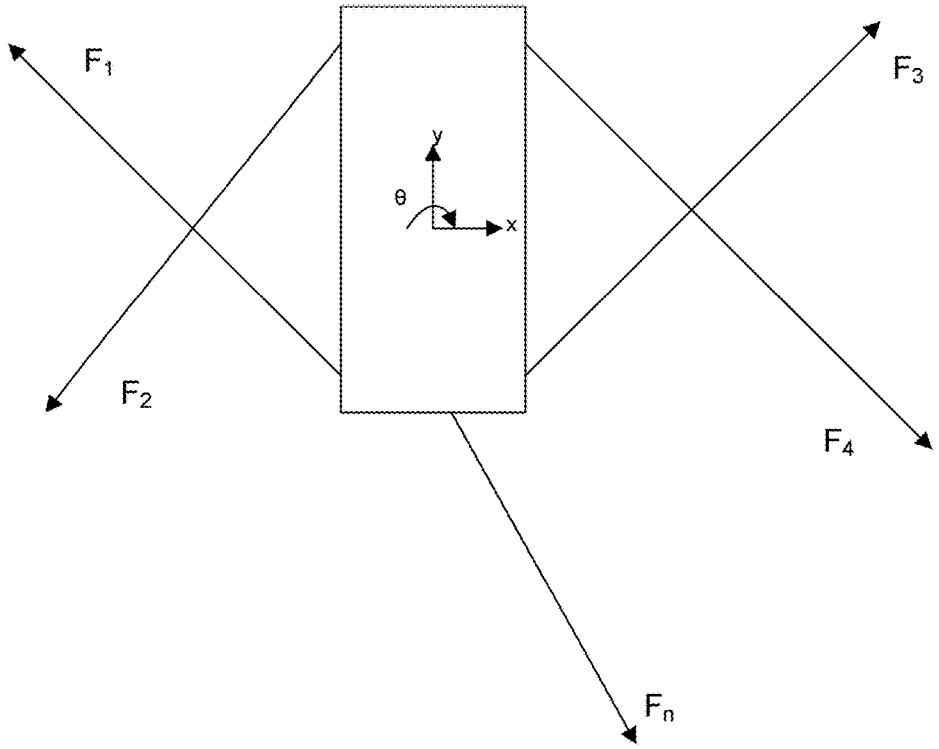
FIG. 7 is a diagrammatic top plan view of a vessel being maneuvered in accordance with the present disclosure, showing the three motions of interest and balancing of forces at play in redundant winch identification (RWI)

In maneuvering a vessel, for example the dredge 10, there are three motions of interest, namely, x axis motion, y-axis motion and rotation, as shown in FIG. 7.

Motions of interest:
desired x position (i.e. northing) and x velocity
desired y position (i.e. easting) and y velocity
desired orientation (i.e. bearing) and rational velocity
Available Control:
winch torques and
speeds of n winches
Constraints:
maximum winch torque and speed,
winches can only contribute to motion control via pulling (pushing will result in slack rope or line and hence does not have any effect on the motion).

The motion control is effected through the balancing of forces (created by the torques of the winches). In order to change the velocity of the vessel, it is essential to control the net difference in the forces on the vessel to create the necessary acceleration to achieve the desired velocity change.

As there are 3 key control motions, these motions can be controlled by using forces generated by 3 winches, also referred to as 'leading' winches. When there are more than 3 winches available for controlling the vessel, the control system must 'choose' the 3 winches to control the motion. The remainder of the winches are in effect not required. For this reason any such winches may be referred to as 'redundant winches'.

However, any such redundant winch will affect the steady state balance of the forces. So as to make the maneuvering problem solvable, these redundant winches must be kept under a defined torque. In order to ensure the maneuvering system uses the least amount of energy to achieve the maneuvering objectives, these redundant winches should be set to have the lowest possible defined torque, thereby minimizing power consumption. This may in one form be achieved through keeping sufficient tension in the rope to keep the rope above the water, thereby achieving the minimization of power consumption. Put another way, the or each winch under defined torque is kept at or near the lowest torque value that achieves a low potential energy while maintaining that winch rope in a responsive state.

The Redundant Winch Identifier (RWI) system is essential for determining which winch(es) should not be utilized to achieve the desired output. The RWI system does this by analyzing which winch(es) is/are least capable of doing useful work in achieving the desired output or result.

The RWI system consists of:

(a) an acceleration calculator, which calculates the vessel's acceleration from the vessel's desired velocity;
(b) a vessel-to-winch velocity converter, which calculates desired velocities of the winches from said vessel's geometry and desired velocity;
(c) a scalar projection calculator, which provides a quantitative comparison of the desired velocities of the winches to the desired rope velocities of the winches; and
(d) a customized minimum selector, which identifies said redundant winches based on the output of an acceleration calculator and a scalar projection calculator.

The vessel is maneuvered via a maneuvering controller sending torque and speed parameters to the winches. The winches have their winch lines attached to remote or onshore anchors as described hereinabove. A user or operator may modify the vessel's trajectory or initiate a new trajectory by sending instructions to the maneuvering controller via a graphical user interface. These instructions are interpreted by the maneuvering controller, and the controller output to the winches is adjusted accordingly to achieve the operator's intentions. The selection of winches to be either redundant or leading is a function of the trajectory parameters.

An acceleration calculator takes, as inputs, the vessel's desired velocity magnitude. The vessel's desired velocity magnitude from the last calculation iteration (i.e. at t=tlast) is subtracted from the vessel's current desired velocity magnitude (i.e. at t=tnow), and the result is divided by the interval between tnow and tlast. A leadlag filter is subsequently applied to smooth the result:

$$accel_{vessel} = \frac{|\text{velocity}_{tnow}| - |\text{velocity}_{tlast}|}{t_{now} - t_{last}}$$

The inputs to the vessel-to-winch velocity converter are the vessel's desired velocity, the vessel's current bearing and the individual winch position relative to the vessel's reference point. Firstly, the sum of the vessel's desired angular velocity and the vessel's current bearing is calculated to give the vessel's desired bearing in one second's time. The cosine and sine components of the quantity are then used to construct a rotation matrix. This rotation matrix is then used to translate the vessel's desired velocity to the winch's desired velocity:

$$\text{Angular velocity}_{1\,second} = \text{angular velocity}_{now} + \text{angular } accel_{vessel}$$

$$a = \cos(\text{angular velocity}_{1\,second}) - \cos(\text{angular velocity}_{now})$$

$$b = \sin(\text{angular velocity}_{1\,second}) - \sin(\text{angular velocity}_{now})$$

$$\begin{bmatrix} x\ accel_{sheave} \\ y\ accel_{sheave} \end{bmatrix} = \begin{bmatrix} x\ accel_{sheave} \\ y\ accel_{sheave} \end{bmatrix} + \begin{bmatrix} a & b \\ -b & a \end{bmatrix} \begin{bmatrix} \text{relative } x \text{ position}_{sheave} \\ \text{relative } y \text{ position}_{sheave} \end{bmatrix}$$

The scalar projection calculator inputs are the winches' desired velocities (from the vessel-to-winch velocity converter) and the winches' desired rope accelerations. The scalar projection quantity is calculated as the dot product of the two input vectors divided by the desired rope acceleration magnitude of the winch:

$$\text{Scalar projection} = \frac{(x\ \text{acceleration}_{sheave})(x\ \text{acceleration}_{rope}) + (y\ \text{acceleration}_{sheave})(y\ \text{acceleration}_{rope})}{|\text{acceleration}_{sheave}|}$$

The customized minimum selector selects the winch with the smallest negative scalar projection to be redundant if the vessel is accelerating, and selects the winch with the smallest positive scalar projection to be redundant if the vessel is decelerating. Vessel acceleration is input from the acceleration calculator, and scalar projections for each winch are input from the scalar projection calculator. If there are n winches, then n-3 winches will be set as redundant. For a vessel with four winches, the redundant winch would be selected using an adaption of the code below.

```
ScalarProj_TempMin = arbitrarily large number for initiation
If      ((ScalarProj_winch1 <= 0 AND a_vessel >= 0) OR (ScalarProj_winch1 >=
        0 AND a_vessel <= 0))
        AND |ScalarProj_winch1| < ScalarProj_TempMin
        then
        ScalarProj_TempMin =|ScalarProj_winch1|;
        Redundant winch number = 1;
End;
If      ((ScalarProj_winch2 <= 0 AND a_vessel >= 0) OR (ScalarProj_winch2 >=
        0 AND a_vessel <= 0))
        AND |ScalarProj_winch2| < ScalarProj_TempMin
        then
        ScalarProj_TempMin =|ScalarProj_winch2|;
        Redundant winch number = 2;
End;
If      ((ScalarProj_winch3 <= 0 AND a_vessel >= 0) OR (ScalarProj_winch3 >=
        0 AND a_vessel <= 0))
        AND |ScalarProj_winch3| < ScalarProj_TempMin
        then
        ScalarProj_TempMin =|ScalarProj_winch3|;
        Redundant winch number = 3;
End;
If      ((ScalarProj_winch4 <= 0 AND a_vessel >= 0) OR (ScalarProj_winch4 >=
        0 AND a_vessel <= 0))
        AND |ScalarProj_winch4| < ScalarProj_TempMin
        then
        ScalarProj_TempMin =|ScalarProj_winch4|;
        Redundant winch number = 4;
End;
```

Thus, using the RWI system as described hereinabove, the maneuvering controller can categories winches as either leading or redundant in order to achieve the desired outputs.

The methods of the present disclosure will now be described with reference to the following non-limiting examples.

EXAMPLES

As noted hereinabove, a control model was developed as a representation of the actual dredge using theoretical analysis of the dredge geometry. The intent in developing the control model was to:

(a) Understand the machine dynamics of the dredge maneuvering system.
(b) Develop, investigate and optimize the dredge maneuvering control strategies.
(c) Check the robustness of the control strategies with respect to uncertainty of the anchor positions.
(d) Provide a means of investigating the effects of anchor positions on the forces from the winches.
(e) Provide an optimizing tool for anchor movement.
(f) Facilitate full functionality testing of the automation software.

The dredge control model developed consists of three sections:

(a) Anchor movement force calculator.
(b) Anchor movement optimizer.
(c) Dredge and winch geometry model.

Sign conventions adopted in the theoretical analysis are consistent throughout the control system:

(a) Positive x-direction—from port to starboard.
(b) Positive y-direction—from stern to bow.
(c) Positive winch speed increases rope length (rope pay-out).
(d) Positive dredge heading direction is clockwise.

Anchor Movement Force Calculator

The anchor movement force calculator was developed to investigate the effects of different anchor positions and the associated winch forces. It is also used to ensure that all resultant forces are within the specified cutter operating limit: Maximum cutter reaction force of 500 kN.

By specifying anchor positions, estimated cutter forces and trajectory, the force calculator calculates the winch forces required. The force calculator enables the investigation of optimal trajectory, and anchor orientations and positions as shown in FIG. 8.

Figure 8:
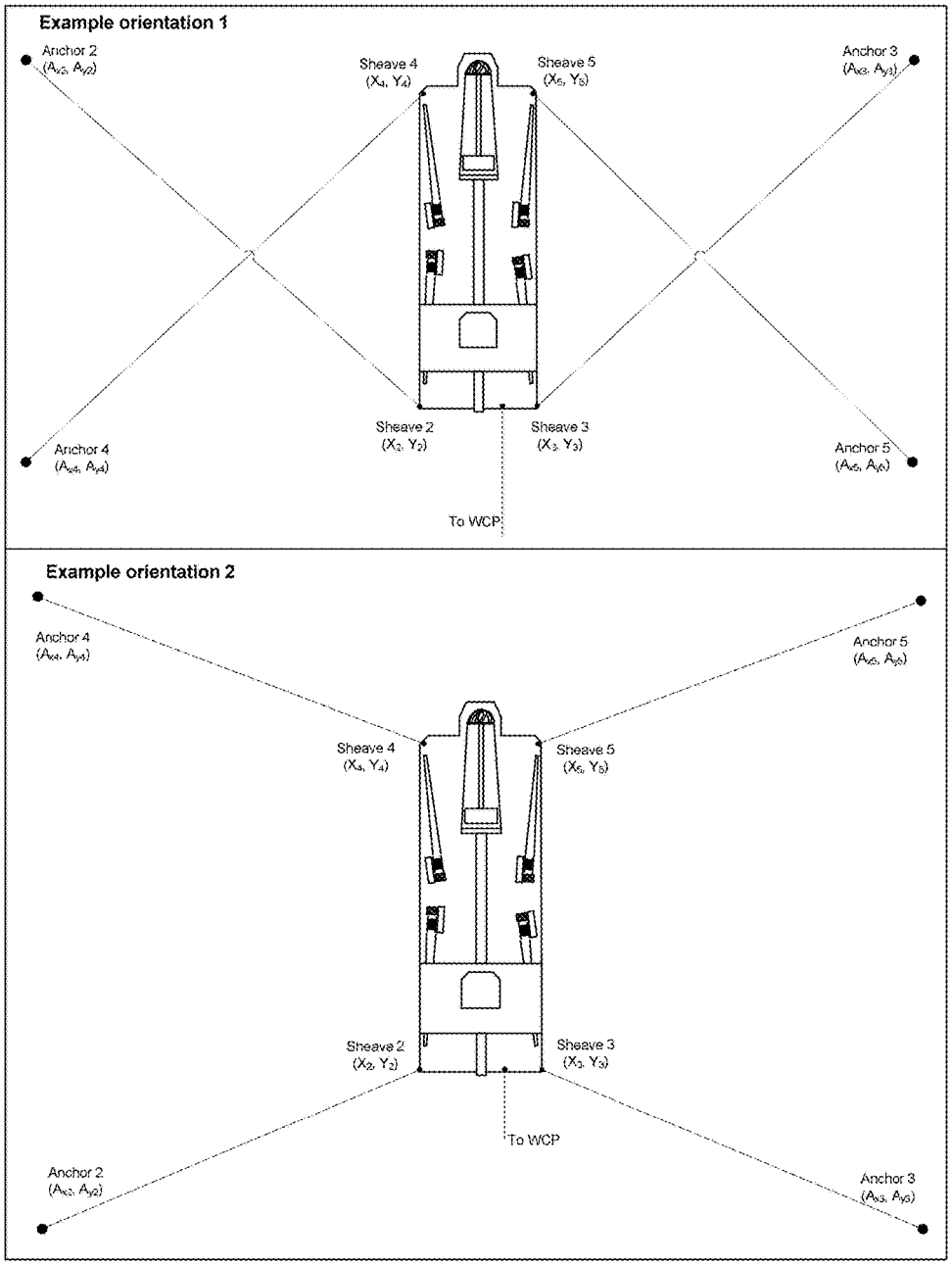
FIG. 8 is a diagrammatic representation of two examples of anchor orientation used in the development of a control model for use in the methods of the present disclosure.

The preliminary force calculator analysis has shown that Example Orientation 2 in FIG. 8 is possible but not favorable, as the separation between anchors is required to be substantially smaller than for Example Orientation 1.

Anchor Movement Optimizer

Figure 9:
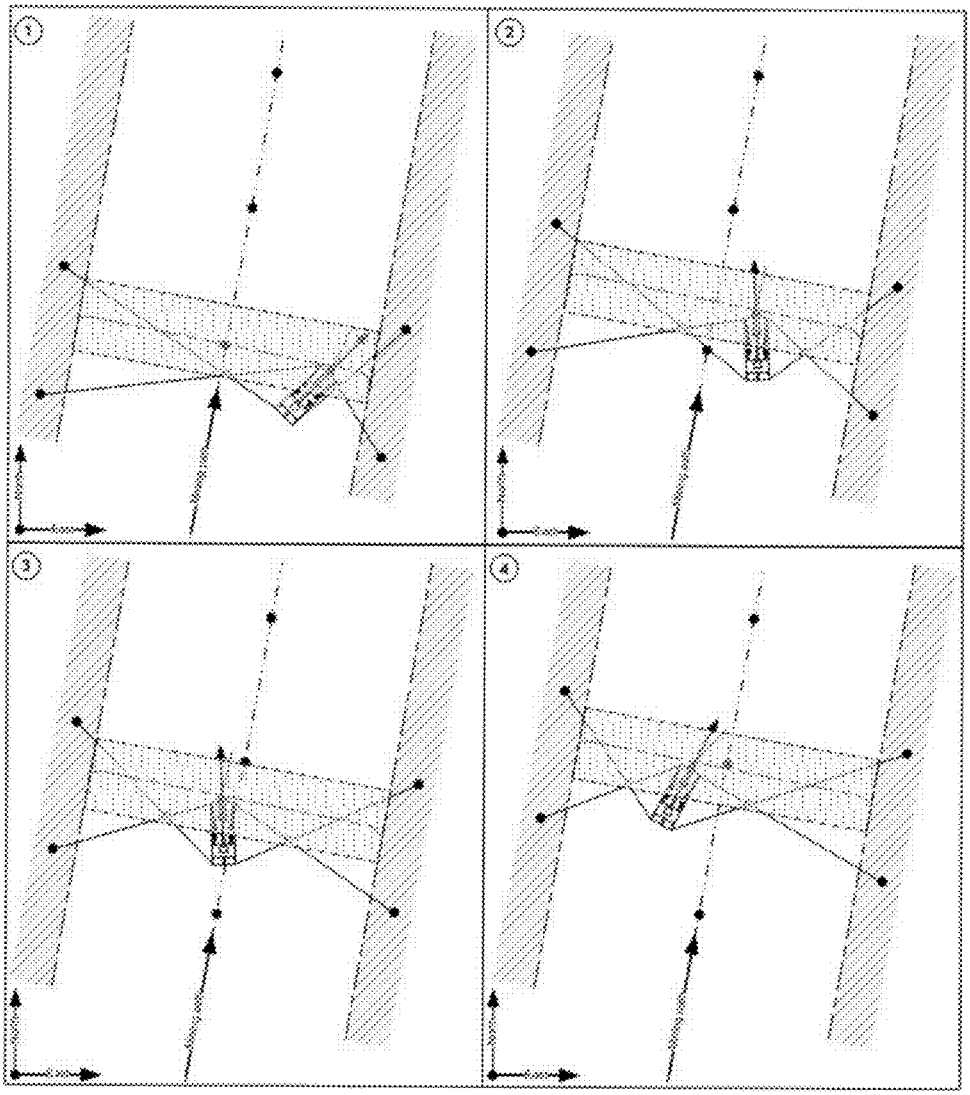
FIG. 9 is a diagrammatic representation of example permissible cutting regions (PCRs) and step advances for anchors for same in accordance with one embodiment of the method of the present disclosure.

Optimizing the movements of the anchors is achieved by identifying PCRs, or permissible movement regions (PMRs) as may be appropriate depending upon the vessel, with every set of anchor locations. As noted above, a PCR is defined as a physical area in which mining is practicable, meaning the current set of anchor locations can provide sufficient forces. The anchor movement force calculator from the previous section shall be extended to determine the PCRs. FIG. 9 shows example PCRs, as shaded transverse areas, and step advances for the anchors, both relative to a starting point.

Dredge and Winch Geometry

The following assumptions apply to the dredge and winch geometry used in the model:

(a) The dredge is assumed to be a lumped mass "centered" at its center of gravity.
(b) Forces due to water drag and wind resistance are modelled as a lumped force acting against the direction of dredge movement.
(c) Rope length shall be assumed to be the distance between each sheave and its respective anchor, not accounting for catenaries.
(d) The output from the speed regulator of each motor shall be assumed to be directly proportional to motor torque.

The overall dredge geometry is shown in FIG. 4. The variables that have been used in the implementation of the model are defined in the following manner. The cutter head has been selected as the origin of the dredge and winch geometry calculations, or the control point. As noted previously, other forms of vessel will require the nomination of their own control point. The cutter head has coordinates ($X_C$, $Y_C$). The heading angle is defined as the angle between the y-direction and the dredge heading. The heading angle is denoted by $\varphi_C$, where the y direction is perpendicular to face.

The maneuvering of the cutter is controlled using 5 winches. Each winch sheave is marked with coordinates ($X_2$, $Y_2$) . . . ($X_6$, $Y_6$). Winch 6 is the tail winch, anchored to the WCP (Wet Concentrator Plant). Corresponding to each winch is a rope length, denoted by $L_2(t) \ldots L_6(t)$.

There are four onshore anchors, marked with coordinates $(A_{X2}, A_{Y2}) \ldots (A_{X5}, A_{Y5})$. The tail winch anchor is marked with coordinate $(A_{X6}, A_{Y6})$. The rope angles formed at the winch sheaves by each rope and the dredge/cutter direction are denoted by $\varphi_2 \ldots \varphi_5$. Winch speeds are denoted by $\omega_2 \ldots \omega_5$. It should be noted that winch 1 refers to the ladder winch.

Figure 10:
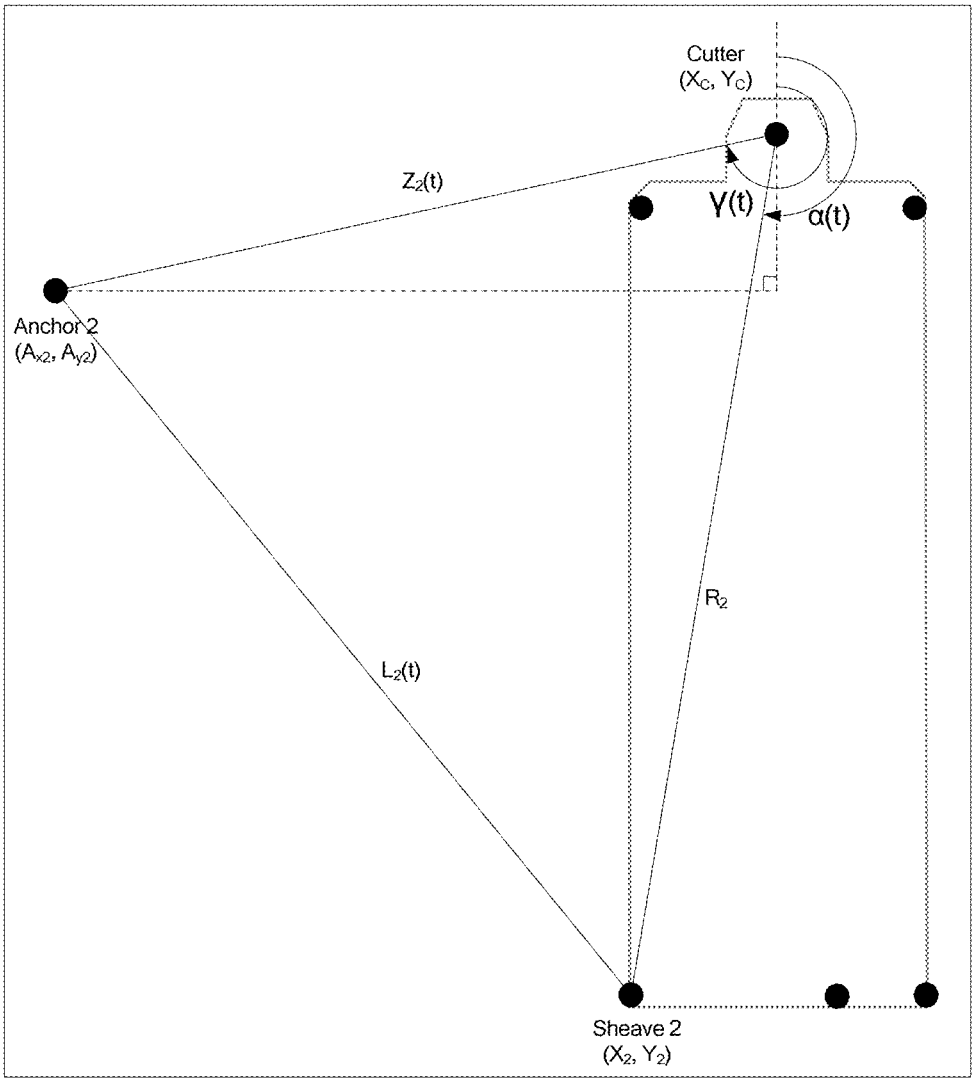
FIG. 10 is a diagrammatic representation of the winch geometry of a single winch used in the development of the control model for use in the methods of the present disclosure.

The geometrical relationships used in the model are illustrated in FIG. 10. The example shown is for winch 2. The illustrated geometrical relationships for winch 2 are also applicable for winches 3, 4, and 5 due to their physical symmetry. Note that the model allows for a non-symmetrical mine face or dune heights (e.g. 5 meters port, 20 meters starboard) and reference may be made to FIG. 5 in this regard.

Figure 5:
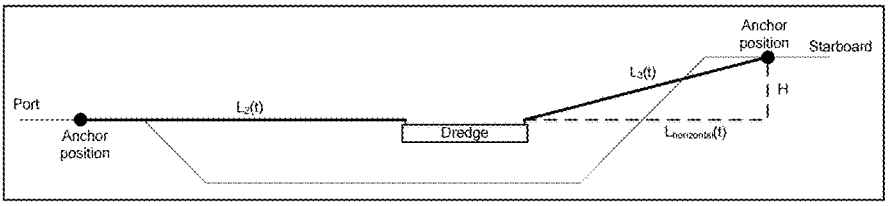
FIG. 5 is a diagrammatic end view of the dynamic model of FIG. 3 representing how that model allows for a non-symmetrical mine face or dune.

In FIGS. 10 and 5, the following variables are defined:

(a) $Z_2(t)$—distance between origin and anchor.

(b) $R_2$—distance between origin and winch sheave position.

(c) $\gamma(t)$—angle from the cutter to Z(t).

(d) $\alpha(t)$—angle from the cutter to R.

(e) H—anchor altitude.

Using trigonometry, a set of equations relating L(t), X, Y and $\gamma(t)$ and can be derived. By differentiating the rope length equations, the rope velocity and rope acceleration equations can be derived. Taking Winch 2 as an example, the following rope length equation is derived:

$$\boxed{L_2(t) = \{S_2(t) + R_2^2 - 2R_2Z_2(t)\cos[\gamma_2(t)] + H^2\}^{1/2}}$$

where $$\gamma_2(t) = \arctan\left\{\frac{|X_C - A_{x2}|}{|Y_C - A_{y2}|}\right\} - \alpha_2(t)$$

Removing the subscripts (equations are applicable for each of the four winches (apart from the tail winch) and differentiating L(t) gives the rate of change of rope length:

$$\frac{\partial L(t)}{\partial t} = \frac{1}{2L(t)}\left\{\frac{\partial}{\partial t}S(t) - \frac{R}{Z(t)}\cos[\gamma(t)]\cdot\frac{\partial}{\partial t}S(t) + 2RZ(t)\sin[\gamma(t)]\cdot\frac{\partial}{\partial t}\gamma(t)\right\}$$

where $$S(t) = (X_C(t) - A_x)^2 + (Y_C(t) - A_y)^2$$

$$Z(t) = \sqrt{(X_C(t) - A_x)^2 + (Y_C(t) - A_y)^2} = \sqrt{S(t)}$$

$$\frac{\partial}{\partial t}S(t) = 2(X_C(t) - A_x)\cdot\frac{\partial}{\partial t}X_C(t) + 2(Y_C(t) - A_y)\cdot\frac{\partial}{\partial t}Y_C(t)$$

$$\frac{\partial}{\partial t}\gamma(t) = \frac{\partial}{\partial t}\arctan\left\{\frac{|X_C(t) - A_x|}{|Y_C(t) - A_y|}\right\} - \frac{\partial}{\partial t}\alpha(t)$$

This enables the calculation of the effective dredge acceleration using the geometrical relationship of the dredge with respect to the anchor points. It is then possible to express the effective acceleration of the dredge in terms of the rope length acceleration.

Figure 6:
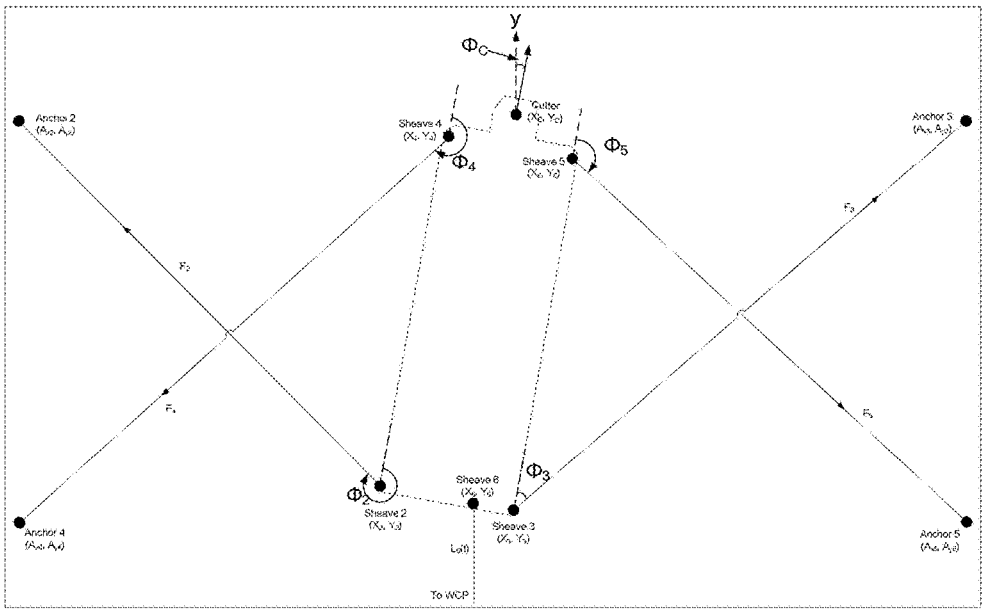
FIG. 6 is a diagrammatic top plan view of the dredge geometry of FIG. 3 with winch forces, showing the direction conventions for the forces, directions and angles required.

Rope length acceleration is directly related to the winch forces (force=mass*acceleration), thereby providing a means to also relate the winch forces to the dredge acceleration. FIG. 6 illustrates the dredge geometry with winch forces, and shows the direction conventions for the forces, directions and angles required. Note that a positive winch speed increases rope length (rope pay-out), and a negative winch speed will pull the rope in (moving the dredge towards the anchor point).

Figure 11:
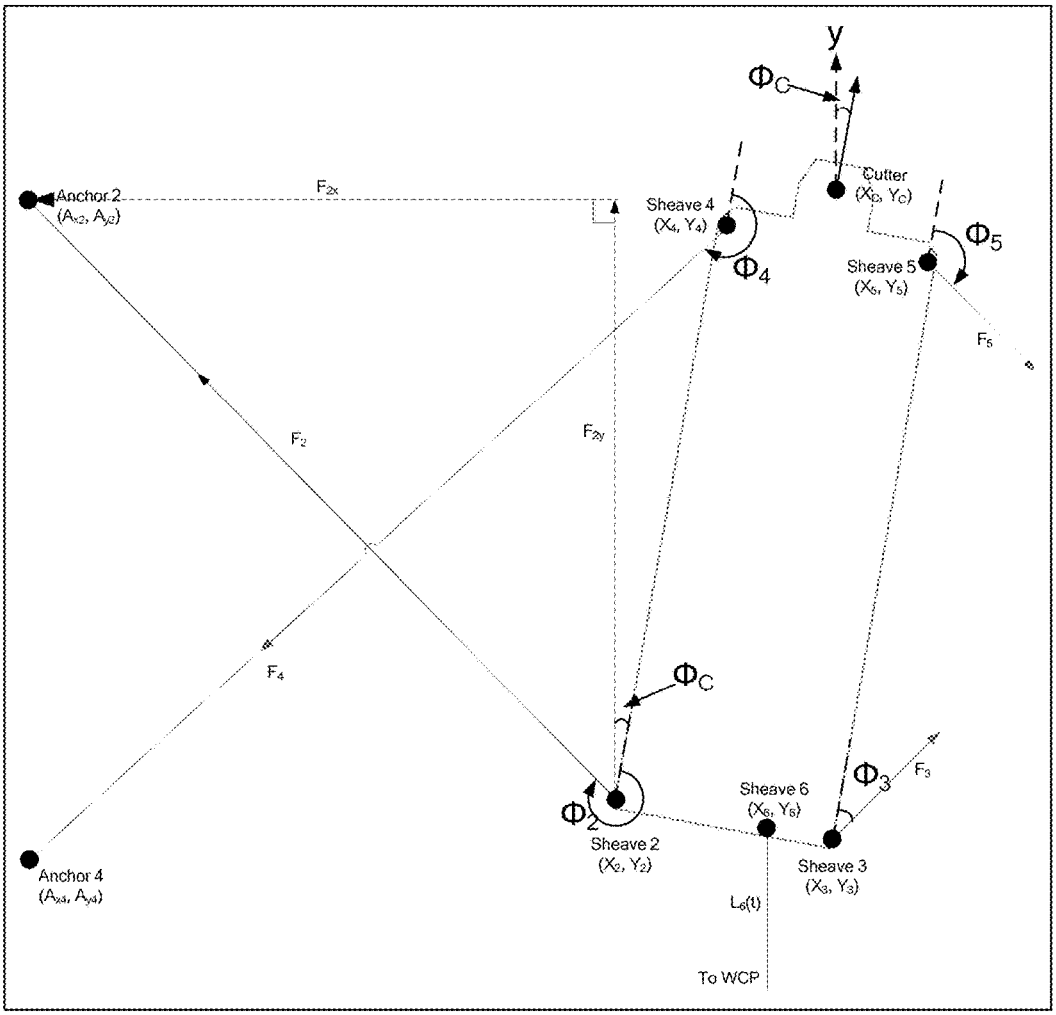
FIG. 11 is a diagrammatic representation of the winch force and acceleration calculation whereby a set of equations can be derived for the forces from winch 2 for the development of a control model for use in the methods of the present disclosure.

Referring to FIG. 11, a set of equations can be derived for the forces from Winch 2.

$$F_{2x} = -F_2\sin(\varphi_2 + \varphi_C)$$

$$F_{2y} = F_2\cos(\varphi_2 + \varphi_C)$$

The forces from Winches 3, 4 and 5 can be derived in a similar manner. Using Newtonian laws relating force to acceleration, the resultant forces can be used to find the linear acceleration of the dredge.

$$\boxed{\begin{aligned} a_x &= \frac{\sum F_x}{m} \\ a_y &= \frac{\sum F_y}{m} \end{aligned}}$$

A similar method can be used to calculate the angular acceleration, using moments in place of forces. Assuming that the dredge is a point mass centered on its center of gravity with the origin (cutter head) as the point of rotation, the resultant moment around the dredge origin is found by summing the moments supplied from each of the winches. Vector equations are used for the calculation of moments. The moment calculation is represented by the following vector equation:

$$\text{moment} = r \times F$$

In the above moment equation, vector r is from the point of rotation to the point of application of the force, while vector F is the force. The moments supplied by each winch are summed together to give the resultant moment that causes the rotation of the dredge. Applying the theory of angular momentum, angular acceleration can be determined as follows.

$$\boxed{\text{Angular acceleration } \ddot{A} = \frac{\text{moment}}{mr^2}}$$

where:

m=mass of the dredge r=distance from the origin to the center of gravity of the dredge As noted hereinabove, other forces taken into account in the model are:

(a) Trailing rope tension—modelled as a fixed force.

(b) Cutting force—subtracted from the resultant forces from the winches as the cutting force always opposes the dredge motion.

(c) Water drag—modelled as a constant load opposing the dredge motion.

(d) Rope weight—modelled as a constant weight acting on the winch.

Simulation Model

As noted hereinabove, the language chosen for the development and implementation of the model is an industry standard simulation language, Matlab™/Simulink™. The model is described in the form of block diagrams using the block diagram language Simulink™. The model parameters in each block diagram are specified as Matlab™ variables, whose values are stored in Matlab™ macro files. Different trajectories and anchor positions may be entered into the system via the user interface of the model.

The model is connected to the PLC software using the Mathworks™ OPC Toolbox™ in order to facilitate full functionality testing of the software.

'Next 10 Anchors Ahead' Management

'Next 10 Anchors Ahead' Management is a strategy developed by the Applicants that is used to plan and physically mark out the next ten anchor positions to be used for each anchor.

Figure 12:
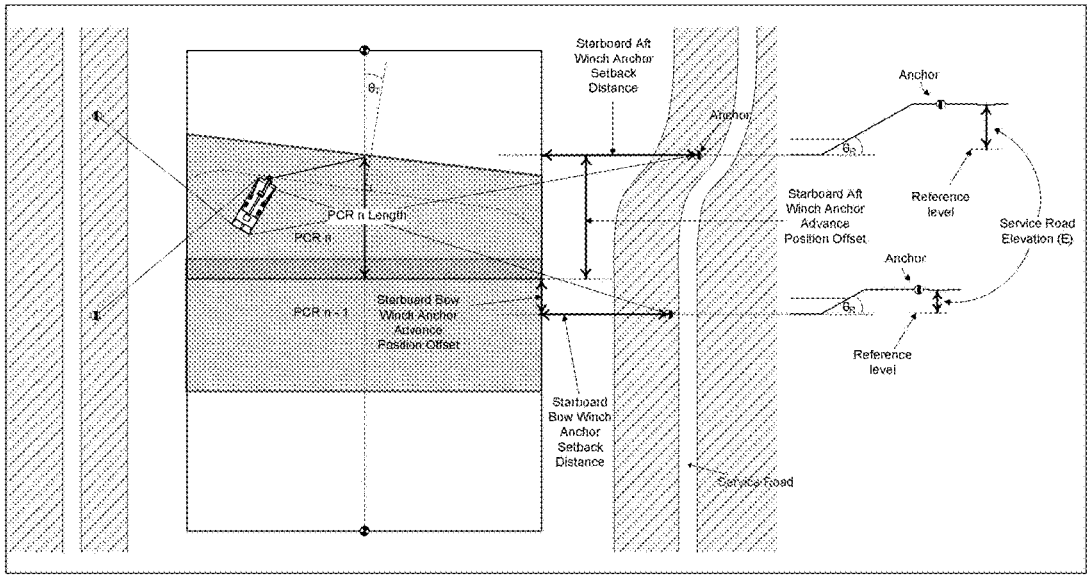
FIG. 12 is a diagrammatic top plan view of permissible cutting/moving region (PCR/PMR) length and relative anchor positions in the mining method of the present disclosure.

The Dredge Maneuvering Force Calculator is used to obtain the PCR length and anchor positions that will allow good dredge throughput without placing excessive requirements on the winches. The PCR length and relative anchor positions are functions of anchoring zone terrain, including for example service road elevation (E), repose angle ($\theta_R$) and pond width, specified trajectory parameters ($\theta_T$), and required reaction force, for example cutter force, as shown in FIG. 12.

The system is able to "stack" PCRs along the length of the Mining Block and determine the anchor positions for each PCR using data exported from the dredge maneuvering force calculator, together with mining block and anchoring zone data.

If obstacles prevent the anchors from being positioned at the calculated positions, the operator shall use the Edit Next Anchor Position function to provide the actual positions manually. Failure to do so will result in deterioration of dredge throughput.

Downtime Reduction

The methods of the present disclosure provide a reduction in downtime relative to methods of the prior art. As noted hereinabove, the methods of the present disclosure provide improved dredge production availability by minimizing unproductive downtime due to spud walk and spud crab motion. Further, using a spudless dredge design the mining area can be improved to at least around 45×200 meters for each set of anchor placements compared to a typical prior art spud dredge mining area of 15×50 meters. Still further, for a prior art spud dredge mining a 200 meters wide mine pond, this translates to three spud walks per centerline and three spud crab motions across the pond resulting in more than a one hour loss in production time for every 45×200 meter mining area.

Further advantages include improving and streamlining the cutting trajectory to improve dredging performance near the pond corner edges, developing a cutting trajectory and cutting sequence that ensures a consistent bite of cut into the ore body, and developing a dredge maneuvering control method that can be used for both shallow and deep operation. It is typically difficult to use prior art spud dredges for depths greater than 22 meters, unless steps are taken to reduce the pond level.

By way of an example in the context of a mining method, given the following parameters:

(i) A pond dimensions of 200 m wide and a pass length of 45 mm;

(ii) A dredge cutter speed of 18 m/min and cut width of 0.7 m;

(iii) Turn around delay (minimized production) for every corner of 0.5 minutes;

(iv) Spud Walk (reposition forward) lost production time of 5 minutes;

(v) Spud Crab (reposition sidewards) loss production time of 15 minutes, the mining method of the present disclosure provides a theoretical downtime saving for the mining of the defined region, of about 26% over traditional prior art spud dredging.

Table 1 provided hereinbelow provides details of the assumptions made and the calculation variables assumed in addition to those noted above in determining the theoretical downtime reduction noted above.

TABLE 1

Downtime Reduction Calculation Variables

| Calculation Variables | | CONVENTIONAL | |
|---|---|---|---|
| Name | Calculation | (SPUD) | HATCH (VIRTUAL SPUD) |
| Forward Reach (m) | N/A | 15 | 45 |
| Horizontal Reach (m) | N/A | 50 | 200 |
| Reposition Forward Delay (min) e.g. Spud Walk Time Delay | N/A | 5 | 0 |
| Reposition Horizontal Delay (min) e.g. Spud Crab Time Delay | N/A | 15 | 0 |
| Edge Turnaround Delay (min) | N/A | 0.5 | 0.5 |
| Number of Forward Moves (#) | ([Total Pond Pass (m)/Forward Reach (m)] − 1) * [Total Pond Width (m)/Horizontal Reach (m)] | 8 | 0 |
| Total Forward Move Delay (min) | [Number of Vertical Moves * Reposition Forward Delay (min)] | 40 | 0 |
| Number of Horizontal Moves (#) | [Total Pond Width (m)/Horizontal Reach (m)] − 1 | 3 | 0 |
| Total Horizontal Move Delay (min) | [Number of Horizontal Moves * Reposition Horizontal Delay (min)] | 45 | 0 |
| Number of Edge Turnarounds (#) | [2 * (Total Pond Width (m)/Horizontal Reach (m)) * (Total Pond Pass (m)/Cut Width (m))] | 514 | 128 |
| Total Edge Turnaround delay (min) | [Number of Edge Turnarounds * Edge Turnaround Delay (min)] | 257 | 64 |
| Total Delay Per Pass (min) | [Total Forward Move Delay (min) + Total Horizontal Move Delay (min) + Total Edge Turnaround delay (min)] | 342 | 64 |
| Total Time Per Reach Area (min) | [Horizontal Reach (m)) * (Forward Reach (m)/Cut Width (m))/Cutter Speed (m/min)] | 59 | 714 |

TABLE 1-continued

| Downtime Reduction Calculation Variables | | | |
|---|---|---|---|
| Calculation Variables | | CONVENTIONAL | |
| Name | Calculation | (SPUD) | HATCH (VIRTUAL SPUD) |
| Total Reach Areas (#) | [Total Pond Pass (m)/Forward Reach (m)] * [Total Pond Width (m)/Horizontal Reach (m)] | 12 | 1 |
| Total Time Per Pass (min) | [Total Time Per Reach Area * Total Reach Areas + Total Delay Per Pass] | 1050 | 778 |

The methods of the present disclosure, particularly as they relate to a mining method, make a number of important contributions to sustainability, in addition to those advantages over the prior art already highlighted.

As the methods of the present disclosure control the dredge to maintain a required trajectory and cut as smoothly as possible into the ore body, equipment wear and tear is minimized thus increasing longevity of the dredge asset and reducing maintenance. This in turn reduces ongoing sustaining capital requirements, manpower and energy inputs all contributing to sustainability.

Due to the methods of the present disclosure offering superior trajectory control, the boundaries of the ore body can be more precisely mined thereby maximizing resource recovery and minimizing unintended impact on surrounding areas.

The methods of the present disclosure optimize the requirements for moving of shore anchors associated with the winches, and provides exact placement co-ordinates. These anchors consist of heavy front end loaders with modified buckets that are located using GPS. Optimizing anchor placement and location reduces manpower and energy inputs.

The methods of the present disclosure are typically implemented at remote sites. As such, it is advantageous to minimize personnel requirements on site and the associated transport and support requirements. The Applicant has contributed to the general control system design to improve reliability and facilitate off-site support, thereby reducing site requirements for technical personnel.

Where the methods of the present disclosure are applied to new dredges during the design phase, the subsequent removal of the spud, spud carriage, ancillary spud and associated equipment/systems provides for substantial reduction in capital expenditure.

As can be seen from the above description, the present disclosure overcomes many, if not all, of the problems of the prior art, in providing, amongst other things, a dredge, vessel or stacker maneuvering method that accommodates a flexible cutting trajectory, without the need for a spud. The method of the present disclosure is able to maneuver the dredge, or some other form of vessel, in a straight trajectory, which theoretically behaves like a spud dredge wherein the spud has a radius of infinity.

Amongst the advantages realized by one or more of the methods of the present disclosure are:

(a) A downtime saving of approximately 26% (typically a few hours) for every 45 meters advance (for a mine width of 200 meters) due to elimination of the need for spud advance and centerline changes. Using the mining method of the present disclosure it is possible to continuously dredge a larger area without any downtime due to anchor moves.

(b) Use of multivariable control techniques to minimize interactions between the maneuvering winches, deliver maximum available cutting forces and avoiding slack rope conditions.

(c) Allows the provision of flexible maneuvering trajectories tailored to suit the profile of the dredge and dredging path, while improving the pond corner dredging efficiency and minimizing fall-back from the ore face. Dual D-GPS receivers positioned on the dredge provide accurate and fast dredge positioning and orientation feedback for the control program. It should be noted that test work has shown the control system capable of maneuvering the dredge to within 300 mm of the required trajectory.

(d) A control strategy which allows the maximizing of cutter power while minimizing the winch torque requirements and, as a result, energy consumption.

Further particular advantages of the present disclosure are realized through the dredge, vessel or stacker maneuvering model developed by the Applicant. As noted above, this model transitions initial and complex geometrical equations into second order differential equations relating winch forces to dredge, vessel or stacker acceleration. The maneuvering force calculator which forms part of the model, allows the effects of different anchor positions to be investigated and optimized, including permissible moving or cutting regions for each set of anchor locations. This approach allows "spudless" maneuvering control for a dredge or vessel, thus overcoming the disadvantages of using a spud. The use of this model allows the accurate prediction of dredge maneuvering forces to optimize anchor positioning. This optimization includes:

(a) Maximizing the permissible moving or cutting area for a particular anchor spacing and setting;

(b) Maximizing the anchor interval to minimize the frequency of anchor moves to increase production efficiency; and (c) An algorithm to maximize anchor position re-use and to minimize the anchor survey requirements. This reduces the risk of too many anchor holes in the field and incorrect anchor positioning.

Figure 13:
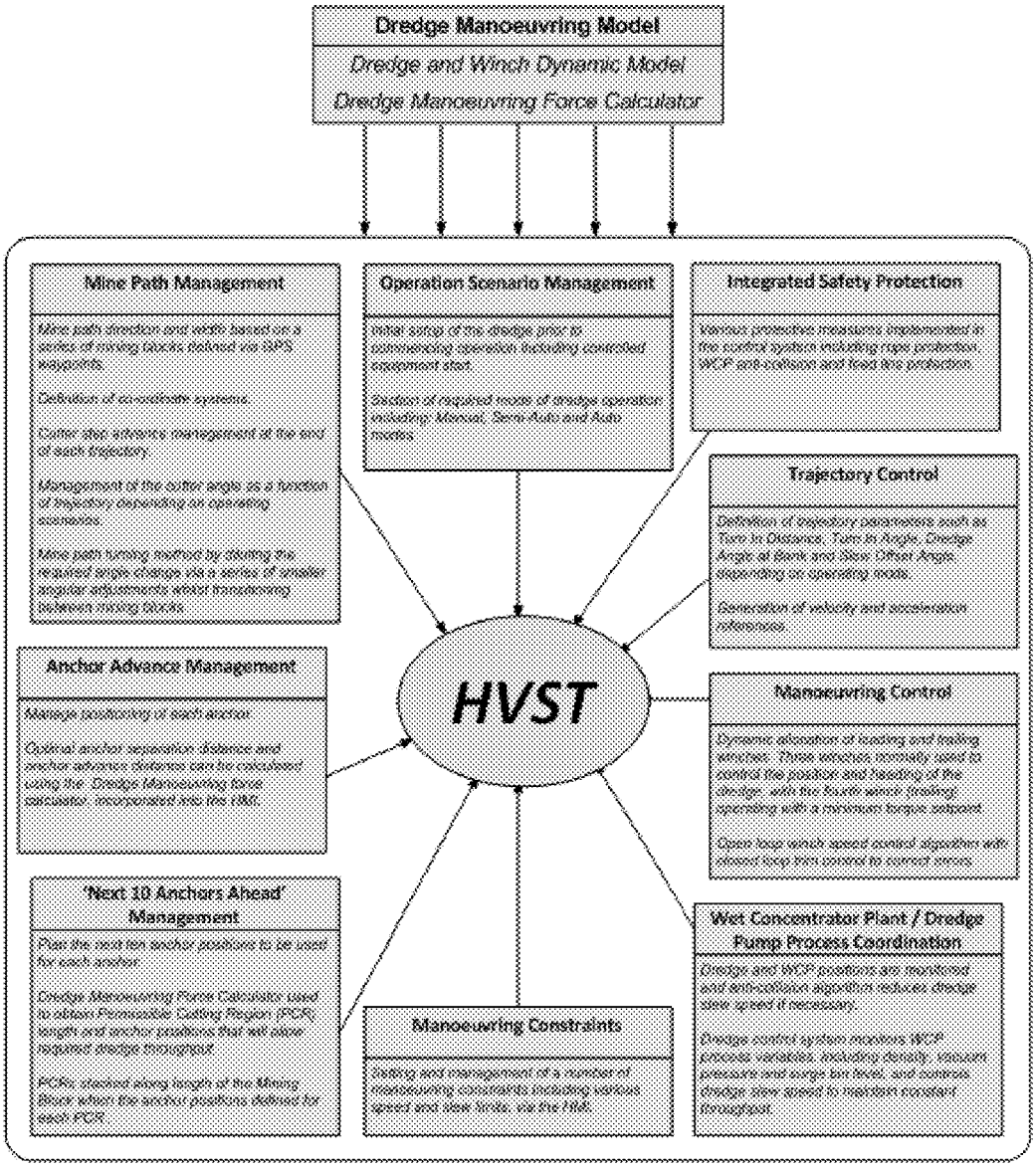
FIG. 13 is a diagrammatic representation of the various components of the methods of the present disclosure.

The methods of the present disclosure define, encompass and link a number of components which provide a comprehensive dredge, vessel or stacker maneuvering control solution. This relationship is shown diagrammatically in FIG. 13 with reference to what the Applicant refers to as the Hatch Virtual Spud Technology (HVST).

Modifications and variations such as would be apparent to the skilled addressee are considered to fall within the scope of the present disclosure.

The invention claimed is:

1. A method for maneuvering a vessel, the vessel having at least four winches from which winch ropes extend to corresponding anchor points located remotely from the vessel, the method comprising:

operating at least one winch to create a defined torque on the winch rope between the vessel and the corresponding anchor point which is at or near the lowest torque value that achieves a low potential energy while maintaining that winch rope in a responsive state, utilizing the other winches to control a movement of the vessel, and providing a redundant winch identifier for determining which winch or winches are redundant and should not be utilized to achieve the movement of the vessel, wherein the vessel is maneuvered in accordance with a preferred trajectory for the vessel.

2. The method according to claim 1, further comprising providing a maneuvering controller for sending torque and speed parameters to the winches.

3. The method according to claim 1, wherein the redundant winch identifier determines which winch or winches is/are least capable of doing useful work in achieving the movement of the vessel.

4. The method according to claim 1, wherein the determination of which winches are redundant or not is a function of parameters of each of the preferred trajectory, a vessel geometry, and a desired velocity of the vessel.

5. The method according to claim 1, wherein the redundant winch identifier determines which winch or winches is least effective for achieving the movement of the vessel and ensuring a proactive approach to the selection of the winches for maneuvering the vessel.

6. The method according to claim 5, wherein in circumstances in which the redundant winch identifier is unable to adopt a proactive approach to the selection of the winches for maneuvering the vessel, a reactive approach to the selection of the winches for maneuvering the vessel is adopted.

7. The method according to claim 5, wherein the proactive approach of the redundant winch identifier comprises:

(a) an acceleration calculator, which calculates the vessel's acceleration from the vessel's desired velocity;

(b) a vessel-to-winch velocity converter, which calculates desired velocities of the winches from said vessel's geometry and desired velocity;

(c) a scalar projection calculator, which provides a quantitative comparison of the desired acceleration of sheaves provided on the vessel and associated with each rope and winch, to the desired accelerations of their respective winch ropes; and (d) a customized minimum selector, which identifies the redundant winches based on the output of an acceleration calculator and a scalar projection calculator.

8. The method according to claim 6, wherein the reactive approach of the redundant winch identifier comprises:

(a) a calculator for converting winch torque feedback to line tension;

(b) a customized minimum selector that acts to identify the or each winch most suitable for redundant winch selection; and (c) a check to determine that the or each winch selected as a redundant winch is performing as expected.

9. The method according to claim 1, wherein the expected performance of the or each winch identified as redundant is such that the winches' velocity is at or near its desired velocity.

10. The method according to claim 1, wherein if a winch identified as redundant is determined not to be operating as expected it is removed from consideration as a redundant winch for a period of time.

11. The method according to claim 1, wherein the vessel is maneuvered via a maneuvering controller sending torque and speed parameters to the winches and the maneuvering controller takes into account factors that limit a maximum speed of the vessel.

12. The method according to claim 11, wherein the factors that limit the maximum speed of the vessel include an input/output protection factor that acts to limit the speed of the vessel so as to protect an input or output device from providing an undesirable result.

13. The method according to claim 12, wherein the input or output device is provided in the form of a cutter head.

14. The method according to claim 12, wherein the input/output protection factor comprises cutter trip protection.

15. The method according to claim 12, wherein the input or output device is provided in the form of a stacking boom.

16. The method according to claim 11, wherein a further factor that limits the maximum speed of the vessel is a process protection factor.

17. The method according to claim 15, wherein the process protection factor acts to limit the speed of the vessel in order to protect a downstream/upstream process from interruption or other negative impact.

18. The method according to claim 2, wherein an operator may modify a trajectory of the vessel or initiate a new trajectory by sending instructions to the maneuvering controller via a graphical user interface.

19. The method according to claim 18, wherein the graphical user interface comprises an X-Y plot depicting a top plan view of the vessel.

20. The method according to claim 19, wherein the X-Y plot allows the operator to visualize the vessel in real time relative to a current preferred trajectory.

21. The method according to claim 19, wherein the X-Y plot allows the operator to visualize historical information regarding the position of the vessel.

22. The method according to claim 21, wherein the real time and historical information depicted on the X-Y plot is provided in a manner in which each is readily distinguishable from the other.

23. The method according to claim 19, wherein the X-Y plot allows the operator to visualize both the vessel in real time relative to a current preferred trajectory and historical information regarding the position of the vessel, and wherein the real time and historical information depicted on the X-Y plot is provided in differing colors.

24. The method according to claim 19, wherein the X-Y plot provides 3-dimensional visualization of the vessel in real time and the historical information in each of an X, Y and Z coordinate.

25. The method according to claim 18, wherein the instructions from the operator are interpreted by the maneuvering controller, and the controller output to the winches is adjusted to achieve the operator's intentions.

26. The method according to claim 1, wherein location of the anchor points is determined by identifying permissible moving regions that comprise an area in which vessel movement is possible because the anchor point locations can provide sufficient forces for that vessel movement through the winches.

27. The method according to claim 26, wherein the identification of permissible moving regions is achieved through use of an anchor movement force calculator, by which winch forces may be calculated for specified anchor point locations and a preferred trajectory.

28. The method according to claim 1, wherein the vessel is one of a spudless dredge, a spudless wet concentrator plant, a barge, a wet concentrator plant, a barge, a wet concentrator plant, a stacker module, or a spudless stacker module, wherein the spudless stacker can optionally be a tailings stacker module.

29. A mining method, the mining method incorporating the method for the maneuvering of a vessel according to claim 28.

30. A stacking method, the stacking method incorporating the method for the maneuvering of a vessel according to claim 26.

31. A maneuvering control system for the implementation of the method according to claim 1.

32. The method according to claim 26, wherein the permissible moving region is a permissible cutting region.

33. The method according to claim 1, wherein the vessel is maneuvered via a maneuvering controller sending torque and speed parameters to the winches.

* * * * *